US010021490B2

(12) United States Patent
Akino

(10) Patent No.: US 10,021,490 B2
(45) Date of Patent: Jul. 10, 2018

(54) MICROPHONE

(71) Applicant: Hiroshi Akino, Kanagawa (JP)

(72) Inventor: Hiroshi Akino, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/353,944

(22) Filed: Nov. 17, 2016

(65) Prior Publication Data

US 2017/0188159 A1 Jun. 29, 2017

(30) Foreign Application Priority Data

Dec. 25, 2015 (JP) ..... 2015-253253

(51) Int. Cl.

| | |
|---|---|
| ***H04R 25/00*** | (2006.01) |
| ***H04R 19/04*** | (2006.01) |
| ***H04R 1/08*** | (2006.01) |
| ***H04R 31/00*** | (2006.01) |

(52) U.S. Cl.
CPC ..... *H04R 19/04* (2013.01); *H04R 1/086* (2013.01); *H04R 31/006* (2013.01)

(58) Field of Classification Search
CPC combination set(s) only.
See application file for complete search history.

(56) References Cited

U.S. PATENT DOCUMENTS 6,560,345 B1 * 5/2003 Hachisuka ..... H04R 17/02 381/354
8,761,427 B2 * 6/2014 Akino ..... H04R 9/08 381/355

FOREIGN PATENT DOCUMENTS

JP 2011-176613 A 9/2011

* cited by examiner

*Primary Examiner* — Amir Etesam
(74) *Attorney, Agent, or Firm* — W&C IP

(57) ABSTRACT

A microphone with a stable electromagnetic shield includes a microphone case having a shape of a hollow cylinder with a bottom end, the microphone case having an opening, an inner circumferential surface, an exterior and an interior, a microphone unit accommodated in the microphone case, a cord bush through which a microphone cord outputting audio signals from the microphone unit passes, the cord bush being fit to the opening of the microphone case, a sound transmission material accommodated in the microphone case, and a communication path establishing communication between the exterior and the interior of the microphone case. The cord defines a part or a whole of the communication path. The communication path is covered by the sound transmission material from the front of the communication path.

17 Claims, 4 Drawing Sheets

MICROPHONE

TECHNICAL FIELD

The present invention relates to microphones.

BACKGROUND ART

A condenser microphone includes a diaphragm configured to vibrate in response to acoustic waves from a sound source and a fixed electrode constituting a capacitor between the fixed electrode and the diaphragm. The capacitance of the capacitor varies in response to the vibration of the diaphragm. The condenser microphone outputs audio signals corresponding to the variation in the capacitance of the capacitor. The audio signals are output to an external device, such as a mixer or a speaker, connected to the condenser microphone.

The condenser microphone can be set to have various directionalities. One of the directionalities is unidirectivity. A unidirectional condenser microphone (hereinafter, referred to as "microphone") collects acoustic waves in a specific direction (for example, the front direction).

FIG. 5 is a cross-sectional right view of a conventional microphone.

A microphone M collects acoustic waves from the sound source. The microphone M includes a microphone case M10, a microphone unit M20, a cord bush M30, a microphone cord M40, and a metal mesh M50.

The front of the microphone M is the direction of the microphone M directed to the sound source during sound collection (the left in FIG. 5). The rear of the microphone M is the direction opposite to the front of the microphone M (the right in FIG. 5).

The microphone case M10 accommodates the microphone unit M20, the front end of the microphone cord M40, and the metal mesh M50. The microphone case M10 is composed of metal, such as brass alloy, for example. The microphone case M10 has a shape of a hollow cylinder with a bottom end. The microphone case M10 has a front sound hole M11*h* and rear sound holes M12*h*. The front sound hole M11*h* introduces acoustic waves from the sound source into the microphone case M10. The front sound hole M11*h* is disposed in the bottom end (the front face) of the microphone case M10. The rear sound holes M12*h* introduce acoustic waves from the sound source to the interior of the microphone case M10. The rear sound holes M12*h* are disposed in the circumferential surface of the microphone case M10.

The microphone unit M20 outputs audio signals corresponding to the acoustic waves from the sound source.

The cord bush M30 prevents breaking of the microphone cord M40. The cord bush M30 is composed of elastic material, such as rubber. The cord bush M30 has a shape of a cone. The cord bush M30 has an insertion hole M31*h*. The insertion hole M31*h* extends along the central axis of the cord bush M30. The microphone cord M40 passes through the insertion hole M31*h*.

The microphone cord M40 is connected to the microphone unit M20 and an external device (not shown), such as a speaker, for example. The microphone cord M40 is a two-core shielded cable including a power cable M41, a signal cable M42, and a shielded cable (not shown). The power cable M41 supplies electrical power to the microphone unit M20. The signal cable M42 outputs the audio signals from the microphone unit M20 to the external device. The shielded cable is grounded. In FIG. 5, the shielded cable is aligned with the power cable M41 and thus is not shown.

The metal mesh M50 prevents foreign objects and electromagnetic waves from entering the microphone case M10. That is, the metal mesh M50 constitutes a part of an electromagnetic shield that prevents electromagnetic waves. The metal mesh M50 is a plain-woven mesh composed of metal, such as stainless steel, for example.

The metal mesh M50 is accommodated in the microphone case M10 together with the microphone unit M20 and the front end portion of the microphone cord M40 connected to the microphone unit M20. The metal mesh M50 is attached to the inner circumferential surface of the microphone case M10 and covers the rear sound holes M12*h* from the inside of the microphone case M10. The cord bush M30 fits to the opening of the microphone case M10 and covers the opening of the microphone case M10 from the rear. The microphone case M10 is fixed to the cord bush M30 with a screw.

Due to the current widespread use of mobile phones, microphones sometimes receive intense electromagnetic waves from mobile phones. When electromagnetic waves intrude into the microphone case, the microphone may generate noise.

Schemes have been proposed to prevent intrusion of electromagnetic waves into a microphone case from a sound hole with a metal mesh covering the sound hole of the microphone case and constituting a part of an electromagnetic shield (for example, refer to Japanese Unexamined Patent Application Publication No. 2011-176613).

SUMMARY OF INVENTION

Technical Problem

When the contact area between the inner circumferential surface of the microphone case and the metal mesh is small, the electrical connection between the inner circumferential surface of the microphone case and the metal mesh often becomes unstable. When the electrical connection between the metal mesh and the microphone case is unstable, the electromagnetic shield of the microphone becomes unstable. As result, in some cases, the electromagnetic waves may intrude into the microphone case from the sound hole. In such a case, the microphone may generate noise.

An object of the present invention is to solve the problems described above and to provide a stable electromagnetic shield in a microphone.

Solution to Problem

The microphone according to the present invention includes a microphone case having a shape of a hollow cylinder with a bottom end, the microphone case having an opening, an inner circumferential surface, an exterior and an interior, a microphone unit accommodated in the microphone case, a cord bush through which a microphone cord outputting audio signals from the microphone unit passes, the cord bush being fit to the opening of the microphone case, a sound transmission material accommodated in the microphone case, and a communication path establishing communication between the exterior and the interior of the microphone case. The cord bush defines a part or a whole of the communication path. The communication path is covered by the sound transmission material from the front of the communication path.

According to the present invention, a stable electromagnetic shield can be provided in a microphone.

DESCRIPTION OF EMBODIMENTS

Embodiments of a microphone according to the present invention will now be described with reference to the attached drawings.

Microphone

The configuration of the microphone according to the present invention will now be described.

Configuration of Microphone

Figure 1:
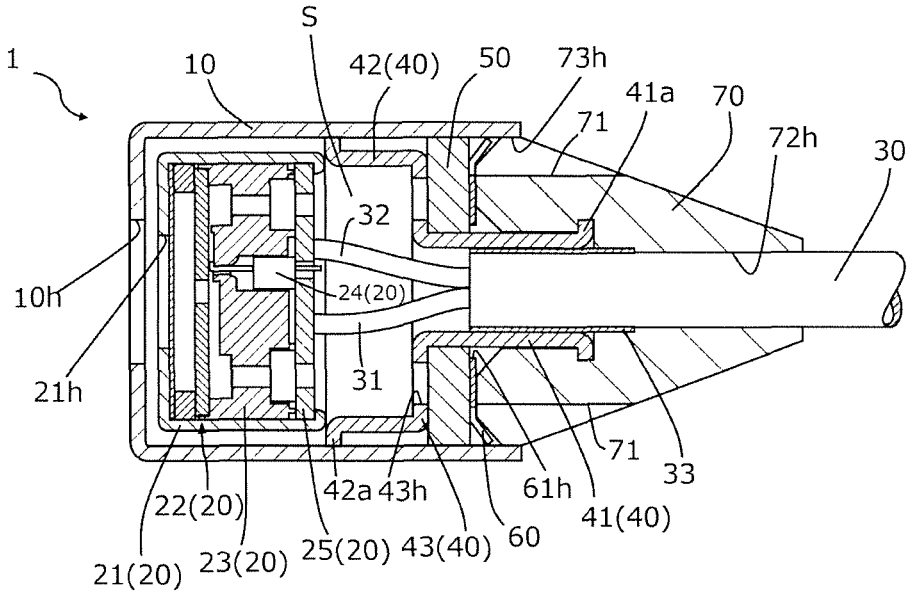
FIG. 1 is a cross-sectional right view of an embodiment of a microphone according to the present invention.

FIG. 1 is a cross-sectional right view of a microphone according to an embodiment of the present invention.

A microphone 1 collects acoustic waves from a sound source. The microphone 1 is a unidirectional condenser microphone, for example.

The front of the microphone 1 is the direction (the left in FIG. 1) of the microphone 1 directed to the sound source during sound collection. The rear of the microphone 1 is the direction (the right in FIG. 1) opposite to the front of the microphone 1.

The microphone 1 includes a microphone case 10, a microphone unit 20, a microphone cord 30, a cord connecting member 40, a sound transmission material 50, a fixing member 60, and a cord bush 70.

The microphone case 10 accommodates the microphone unit 20, the cord connecting member 40, the sound transmission material 50, and the fixing member 60. The microphone case 10 is composed of brass alloy and has a shape of a hollow cylinder with a bottom end, for example. The microphone case 10 has a sound hole 10*h*. The sound hole 10*h* introduces acoustic waves from the sound source into the microphone case 10. The sound hole 10*h* is disposed in the bottom end (a front face) of the microphone case 10.

The microphone unit 20 outputs audio signals corresponding to the acoustic waves from the sound source. The microphone unit 20 includes a unit case 21, an electroacoustic transducer 22, an insulating base 23, an impedance converter 24, and a circuit board 25.

The unit case 21 accommodates the electroacoustic transducer 22, the insulating base 23, the impedance converter 24, and the circuit board 25. The unit case 21 has a shape of a hollow cylinder with a bottom end. The unit case 21 has a sound hole 21*h*. The sound hole 21*h* introduces the acoustic waves introduced to the microphone case 10 into the unit case 21. The sound hole 21*h* is disposed in the bottom end (a front face) of the unit case 21. The electroacoustic transducer 22, the insulating base 23, the impedance converter 24, and the circuit board 25 are accommodated in the unit case 21 through the opening of the unit case 21. The circuit board 25 covers the opening of the unit case 21.

The electroacoustic transducer 22 includes a diaphragm configured to vibrate in response to acoustic waves from the sound source, a fixed electrode constituting a capacitor with the diaphragm, and a spacer. The diaphragm faces the fixed electrode with the spacer disposed therebetween.

The insulating base 23 supports the fixed electrode of the electroacoustic transducer 22.

The impedance converter 24 is the impedance converter of the electroacoustic transducer 22. The impedance converter 24 is electrically connected to the fixed electrode of the electroacoustic transducer 22 and the circuit board 25.

The circuit board 25 is electrically connected to the impedance converter 24 and the microphone cord 30. The circuit board 25 includes leads (not shown) connected respectively to the gate, drain, and source electrodes of the impedance converter 24.

The microphone cord 30 is connected to the microphone unit 20 and an external device (not shown), such as a speaker, for example. The audio signals from the microphone unit 20 are output to the microphone cord 30. The microphone cord 30 is a two-core shielded cable including a power cable 31, a signal cable 32, and a shielded cable (not shown). The power cable 31 supplies power to the microphone unit 20, for example. The signal cable 32 outputs the audio signals from the impedance converter 24 to the external device. The shielded cable is grounded. The shielded cable is exposed at the front end of the microphone cord 30. The exposed portion of the shielded cable is bent back to form an exposed shielded cable portion 33 covering the outer circumferential surface of the front end of the microphone cord 30.

The cord connecting member 40 is connected to the front end of the microphone cord 30. The cord connecting member 40 is composed of conductive material, such as metal. The cord connecting member 40 has a small-diameter cylindrical portion 41, a large-diameter cylindrical portion 42, and a step portion 43.

The small-diameter cylindrical portion 41 fixes the microphone cord 30. The small-diameter cylindrical portion 41 has a shape of a cylinder. The small-diameter cylindrical portion 41 has a protrusion 41*a*. The protrusion 41*a* extends around the entire outer circumference of the rear end of the small-diameter cylindrical portion 41.

The large-diameter cylindrical portion 42 has a shape of a cylinder. The inner diameter of the large-diameter cylindrical portion 42 is larger than the inner diameter of the small-diameter cylindrical portion 41. The large-diameter cylindrical portion 42 has a protrusion 42*a*. The protrusion 42*a* extends around the entire outer circumference of the front end of the large-diameter cylindrical portion 42.

The step portion 43 is disposed between the small-diameter cylindrical portion 41 and the large-diameter cylindrical portion 42. The step portion 43 connects the small-diameter cylindrical portion 41 and the large-diameter cylindrical portion 42. The step portion 43 has a shape of a ring in plan view. The step portion 43 has multiple penetrating holes 43*h*. The penetrating holes 43*h* are disposed in the step portion 43 at equal intervals along the circumferential direction of the step portion 43. The penetrating holes 43*h* will be described below.

The number and positions of the penetrating holes 43*h* are not limited to the present embodiment. That is, the penetrating holes may be disposed along the circumferential direction of the step portion 43 at unequal intervals, for example.

The sound transmission material 50 prevents intrusion of foreign objects and electromagnetic waves into the microphone case 10. That is, the sound transmission material 50 constitutes a part of an electromagnetic shield preventing electromagnetic waves. The sound transmission material 50 may also serve as an acoustic resistor. The sound transmission material 50 is composed of conductive material transmitting acoustic waves, such as conductive fabric. The sound transmission material 50 has a shape of a ring with a central hole in plan view, for example. The inner diameter (diameter of the central hole) of the sound transmission material 50 is larger than the outer diameter of the small-diameter cylindrical portion 41.

Figure 2:
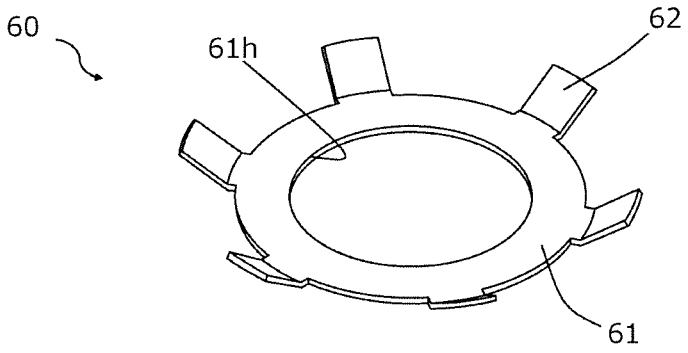
FIG. 2 is a perspective view of a fixing member of the microphone in FIG. 1.

FIG. 2 is a perspective view of the fixing member 60 of the microphone 1.

The fixing member 60 fixes the sound transmission material 50 inside the microphone case 10 and covers a part of the opening of the microphone case 10. The fixing member 60 prevents the components accommodated in the microphone case 10, such as the cord connecting member 40 and the sound transmission material 50, from falling out of the microphone case 10. The fixing member 60 is a CR type retaining ring, for example. The fixing member 60 has a shape of a plate and includes a ring portion 61 and multiple contact portions 62. The ring portion 61 has a shape of a ring and an insertion hole 61*h* on the center. The contact portions 62 extend radially from the rim of the ring portion 61 in diagonally rear direction. The ring portion 61 is integrated with the contact portions 62.

Figure 3:
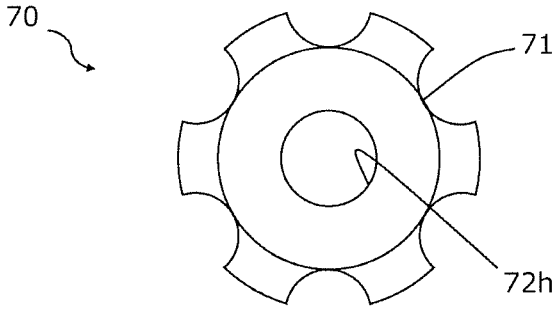
FIG. 3 is a rear view of a cord bush of the microphone in FIG. 1.

FIG. 3 is a rear view of the cord bush 70.

The cord bush 70 prevents breaking of the microphone cord 30. The cord bush 70 has a shape of a circular truncated cone. The cord bush 70 includes multiple communication grooves 71 and an insertion hole 72*h*.

The communication grooves 71 are disposed on the outer circumferential surface of the cord bush 70 at six positions at equal intervals along the circumferential direction of the cord bush 70. The communication grooves 71 extend along the central axis of the cord bush 70 (see FIG. 1). The communication grooves 71 will be described below. The insertion hole 72*h* extends along the central axis of the cord bush 70. The microphone cord 30 passes through the insertion hole 72*h*.

The number and positions of the communication grooves 71 are not limited to the present embodiment. That is, the communication grooves may be disposed along the circumferential direction of the cord bush 70 at unequal intervals, for example.

As shown in FIG. 1, the inner diameter of the front half of the insertion hole 72*h* is larger than the inner diameter of the rear half of the insertion hole 72*h*. The insertion hole 72*h* has a groove to fit with the protrusion 41*a* of the small-diameter cylindrical portion 41. The groove is disposed on the inner circumferential surface at the rear edge of the front half of the insertion hole 72*h*.

Method of Manufacturing Microphone 1

A method of manufacturing the microphone 1 will now be described with reference to FIG. 1.

The sound transmission material 50 and the fixing member 60 are fixed to the cord connecting member 40. The small-diameter cylindrical portion 41 of the cord connecting member 40 is inserted into the central hole of the sound transmission material 50 and the insertion hole 61*h* in the fixing member 60 from the front. The sound transmission material 50 is disposed between the step portion 43 of the cord connecting member 40 and the fixing member 60. That is, the fixing member 60 is disposed in the rear of the sound transmission material 50. The sound transmission material 50 covers the penetrating holes 43*h* of the step portion 43 from the rear of the step portion 43.

The exposed shielded cable portion 33 of the microphone cord 30 is inserted into the small-diameter cylindrical portion 41 from the rear. The power cable 31 and the signal cable 32 of the microphone cord 30 are exposed at the front end of the microphone cord 30. In this state, the small-diameter cylindrical portion 41 is swaged with a tool (not shown), for example. Thus, the inner circumferential surface of the small-diameter cylindrical portion 41 comes into tight contact with the exposed shielded cable portion 33. As a result, the exposed shielded cable portion 33 is fixed to the small-diameter cylindrical portion 41. The exposed shielded cable portion 33 is electrically connected to the small-diameter cylindrical portion 41. In this way, the small-diameter cylindrical portion 41 is connected to the front end of the microphone cord 30.

Then, the small-diameter cylindrical portion 41 is attached to the cord bush 70. The small-diameter cylindrical portion 41 is inserted into the front half of the insertion hole 72*h* of the cord bush 70 and is disposed in the front half of the insertion hole 72*h* in the cord bush 70. The protrusion 41*a* of the small-diameter cylindrical portion 41 is fit to the groove of the insertion hole 72*h* in the cord bush 70. As a result, the cord connecting member 40 is fixed to the cord bush 70. The sound transmission material 50 and the fixing member 60 are held between the step portion 43 and the cord bush 70. The front face of the sound transmission material 50 covers the penetrating holes 43*h* of the step portion 43 from the rear of the step portion 43 and comes into contact with the rear face of the step portion 43. The front face of the fixing member 60 comes into contact with the rear face of the sound transmission material 50. The fixing member 60 is disposed between the sound transmission material 50 and the cord bush 70. The contact portions 62 of the fixing member 60 are disposed between two adjacent communication grooves 71 in the cord bush 70. That is, the communication grooves 71 are placed between two adjacent contact portions 62. The front face of the cord bush 70 comes into contact with the rear face of the fixing member 60. That is, the sound transmission material 50 in tight contact with the rear face of the step portion 43 and the front face of the fixing member 60 is fixed with the cord bush 70. The microphone cord 30 is inserted into the rear half of the insertion hole 71*h* of the cord bush 70.

Then, the power cable 31 and the signal cable 32 are fixed to the circuit board 25 of the microphone unit 20.

Then, the microphone unit 20, the power cable 31, the signal cable 32, the cord connecting member 40, the sound transmission material 50, and the fixing member 60 are accommodated in the microphone case 10. At this time, the microphone unit 20, the power cable 31 and signal cable 32 of the microphone cord 30, the cord connecting member 40, the sound transmission material 50, and the fixing member 60 are disposed in this order from the front of the microphone case 10. The cord bush 70 is fit to the opening of the microphone case 10 and covers the opening of the microphone case 10. That is, the cord bush 70 is attached to the microphone case 10.

Figure 4:
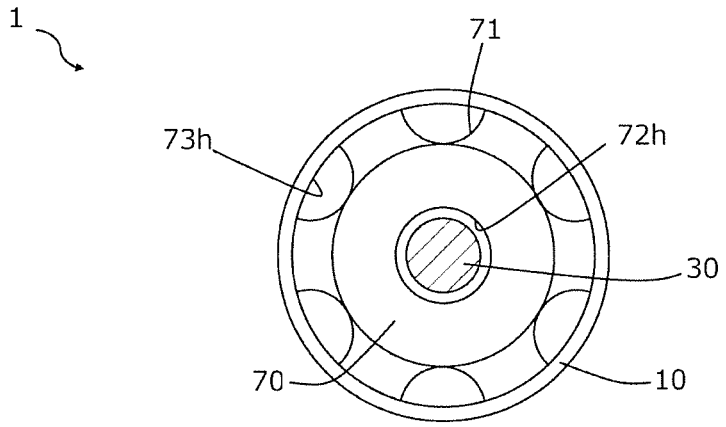
FIG. 4 is a rear view of the microphone in FIG. 1.
Figure 5:
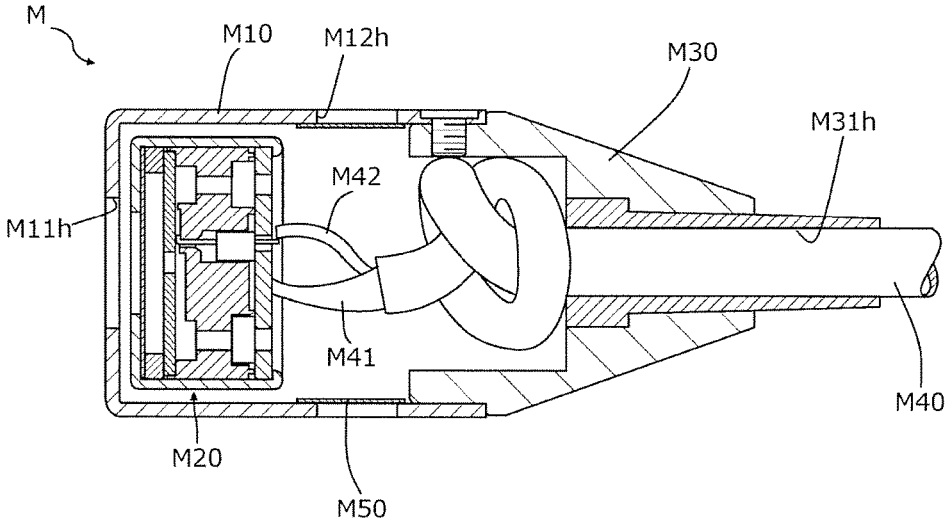
RELATED ART FIG. 5
FIG. 5 is a cross-sectional right view of a conventional microphone.

FIG. 4 is rear view of the microphone 1.

The front half of the communication grooves 71 of the cord bush 70 face the inner circumferential surface of the microphone case 10 (see FIG. 1). The inner circumferential surface of the microphone case 10 and the communication grooves 71 constitute communication paths 73*h*. That is, the cord bush 70 defines a part of each communication path 73. The communication paths 73*h* establish communication between the exterior and the interior of the microphone case 10.

In the present invention, a communication path may be a hole penetrating a cord bush in the front-rear direction. In such a case, the cord bush has the communication path. In other words, the cord bush defines a whole of the communication path.

As shown in FIG. 1, the protrusion 42*a* of the large-diameter cylindrical portion 42 comes into contact with the inner circumferential surface of the microphone case 10. That is, the cord connecting member 40 is electrically connected to the microphone case 10 and the exposed shielded cable portion 33 at the front end of the microphone cord 30. At this time, the microphone case 10, the large-diameter cylindrical portion 42, the step portion 43, and the microphone cord 30 define a space (hereinafter referred to as "space S") accommodating the microphone unit 20 inside the microphone case 10.

The communication paths 73*h* establish communication between the space S and the exterior of the microphone case 10. In other words, the exterior of the microphone case 10 communicates with the space S through the communication paths 73*h*, the spaces between adjacent contact portions 62 of the fixing member 60, the sound transmission material 50, and the penetrating holes 43*h*.

The outer circumferential surface of the sound transmission material 50 comes into contact with the inner circumferential surface of the microphone case 10. The inner circumferential surface of the sound transmission material 50 comes into contact with the outer circumferential surface of the small-diameter cylindrical portion 41. That is, the sound transmission material 50 is electrically connected to the microphone case 10, the small-diameter cylindrical portion 41, the step portion 43, and the fixing member 60. The communication paths 73*h* are covered by the sound transmission material 50 from the front.

The contact portions 62 of the fixing member 60 come into contact with the inner circumferential surface of the microphone case 10. As a result, the fixing member 60 covers a part of the opening of the microphone case 10 and the fixing member 60 is electrically connected with the microphone case 10.

In this way, the microphone case 10, the cord connecting member 40, the sound transmission material 50, and the fixing member 60 are electrically connected with each other. The sound transmission material 50 covers the penetrating holes 43*h* and the communication paths 73*h*. The sound transmission material 50 is held between the step portion 43 and the fixing member 60. Thus, the electrical connection between the sound transmission material 50 and the other components becomes stable. As a result, the microphone case 10, the cord connecting member 40, the sound transmission material 50, and the fixing member 60 constitute a stable electromagnetic shield in the microphone 1.

Acoustic waves from the sound source are introduced into the microphone case 10 (space S) through the communication paths 73*h* in the cord bush 70, the spaces between adjacent contact portions 62 of the fixing member 60, the sound transmission material 50, and the penetrating holes 43*h* and reach the microphone unit 20. That is, the communication paths 73*h* function as introducing holes for introducing acoustic waves to the rear face of the diaphragm of the microphone unit 20, to establish unidirectivity of the microphone.

CONCLUSION

According to the embodiment described above, the sound transmission material 50 covering the penetrating holes 43*h* and the communication paths 73*h* is held between the cord connecting member 40 and the fixing member 60 and fixed inside the microphone case 10. That is, the microphone case 10, the cord connecting member 40, the sound transmission material 50, and the fixing member 60 are electrically connected to each other to constitute a stable electromagnetic shield in the microphone 1. As a result, electromagnetic waves from the communication paths 73*h* are blocked by the electromagnetic shield and prevented from intruding into the microphone case 10. That is, the microphone 1 does not generate noise. In other words, the microphone according to the present invention is provided with a stable electromagnetic shield.

The invention claimed is:

1. A microphone comprising:

a microphone case having a shape of a hollow cylinder with a bottom end, the microphone case having an opening, an inner circumferential surface, an exterior and an interior;

a microphone unit accommodated in the microphone case;

a cord bush comprising a first hole through which a microphone cord outputting audio signals from the microphone unit passes, the cord bush being fit to the opening of the microphone case, the cord bush comprising a groove or a second hole that is different from the first hole;

a sound transmission material accommodated in the microphone case; and a communication path establishing communication between the exterior and the interior of the microphone case, wherein the cord bush defines a part or a whole of the communication path with the groove or the second hole, the communication path is covered by the sound transmission material from a front of the communication path, and an axis of the first hole and an axis of the groove or second hole are displaced in the radial direction of the cord bush from one another.

2. The microphone according to claim 1, wherein, the cord bush has an outer circumferential surface, the cord bush has the groove in the outer circumferential surface of the cord bush, and the communication path is defined by the inner circumferential surface of the microphone case and the groove.

3. The microphone according to claim 1, wherein the cord bush has the second hole, and the communication path is defined by the second hole.

4. The microphone according to claim 1, further comprising:

a fixing member disposed in a rear of the sound transmission material, wherein the fixing member covers a part of the opening of the microphone case, and the fixing member comprises a shape of a plate.

5. The microphone according to claim 4, wherein the fixing member is disposed between the sound transmission material and the cord bush.

6. The microphone according to claim 5, further comprising:

a cord connecting member connected to the microphone case and one end of the microphone cord, wherein the sound transmission material is disposed between the fixing member and the cord connecting member, the cord connecting member has a penetrating hole, and the penetrating hole is covered by the sound transmission material from the rear of the sound transmission material.

7. The microphone according to claim 6, wherein
the cord connecting member comprises:
a small-diameter cylindrical portion; and
a large-diameter cylindrical portion,
the small-diameter cylindrical portion is connected to the one end of the microphone cord, and
the large-diameter cylindrical portion has a protrusion in contact with the inner circumferential surface of the microphone case.

8. The microphone according to claim 7, wherein
the cord connecting member has a step portion,
the large-diameter cylindrical portion and the small-diameter cylindrical portion are connected with the step portion, and
the penetrating hole is disposed in the step portion.

9. The microphone according to claim 7, wherein
the fixing member comprises:
an insertion hole through which the small-diameter cylindrical portion passes; and
a contact portion contacting with the inner circumferential surface of the microphone case.

10. The microphone according to claim 1, wherein the sound transmission material has conductivity.

11. A microphone comprising:
a microphone case having a shape of a hollow cylinder with a bottom end, the microphone case having an opening, an inner circumferential surface, an exterior and an interior;
a microphone unit accommodated in the microphone case;
a cord bush through which a microphone cord outputting audio signals from the microphone unit passes, the cord bush being fit to the opening of the microphone case;
a sound transmission material accommodated in the microphone case;
a fixing member disposed in a rear of the sound transmission material;
a cord connecting member connected to the microphone case and one end of the microphone cord; and
a communication path establishing communication between the exterior and the interior of the microphone case, wherein
the cord bush defines a part or a whole of the communication path,
the communication path is covered by the sound transmission material from a front of the communication path,
the fixing member covers a part of the opening of the microphone case,
the fixing member is disposed between the sound transmission material and the cord bush,
the sound transmission material is disposed between the fixing member and the cord connecting member,
the cord connecting member has a penetrating hole, and
the penetrating hole is covered by the sound transmission material from the rear of the sound transmission material.

12. The microphone according to claim 11, wherein
the cord bush has an outer circumferential surface,
the cord bush has a groove in the outer circumferential surface of the cord bush, and
the communication path is defined by the inner circumferential surface of the microphone case and the groove.

13. The microphone according to claim 11, wherein
the cord bush has a hole, and
the communication path is defined by the hole.

14. The microphone according to claim 11, wherein
the cord connecting member comprises:
a small-diameter cylindrical portion; and
a large-diameter cylindrical portion,
the small-diameter cylindrical portion is connected to the one end of the microphone cord, and
the large-diameter cylindrical portion has a protrusion in contact with the inner circumferential surface of the microphone case.

15. The microphone according to claim 14, wherein
the cord connecting member has a step portion,
the large-diameter cylindrical portion and the small-diameter cylindrical portion are connected with the step portion, and
the penetrating hole is disposed in the step portion.

16. The microphone according to claim 14, wherein
the fixing member has a shape of a plate,
the fixing member comprises:
an insertion hole through which the small-diameter cylindrical portion passes; and
a contact portion contacting with the inner circumferential surface of the microphone case.

17. The microphone according to claim 11, wherein the sound transmission material has conductivity.

* * * * *